United States Patent [19]

Dapp et al.

[11] 4,260,664

[45] Apr. 7, 1981

[54] TRANSFER ELEMENTS AND PROCESS

[75] Inventors: George P. Dapp; Michael A. Scott, both of Huntington, N.Y.

[73] Assignee: Columbia Ribbon & Carbon Mfg. Co., Inc., Plainview, N.Y.

[21] Appl. No.: 964,029

[22] Filed: Nov. 27, 1978

[51] Int. Cl.[3] ..... B41J 31/00; B41J 31/04; B41M 5/02

[52] U.S. Cl. ..... 428/476.9; 400/241.1; 400/241.2; 427/146; 427/153; 428/307; 428/336; 428/337; 428/339; 428/523; 428/914

[58] Field of Search ..... 106/27, 28; 400/237, 400/241, 241.1, 241.2; 427/141, 146, 153; 428/304, 307, 497, 523, 914, 336, 337, 339, 476.9; 260/37 R, 37 M, 37 N, 37 NP, 37 P

[56] References Cited

U.S. PATENT DOCUMENTS

| | | | |
|---|---|---|---|
| 1,439,623 | 12/1922 | Farkas | 106/28 X |
| 1,738,798 | 12/1929 | Richter et al. | 106/28 X |
| 3,052,568 | 9/1962 | Sites et al. | 106/28 X |
| 3,105,769 | 10/1963 | Ellerin | 106/28 X |
| 3,275,465 | 9/1966 | Rathke et al. | 106/27 X |
| 3,825,437 | 7/1974 | Blair | 428/474.4 |
| 3,825,470 | 7/1974 | Elbert et al. | 428/497 X |
| 3,844,994 | 10/1974 | Vijayendran | 106/27 X |
| 3,847,850 | 11/1974 | Rudolphy | 106/27 X |
| 4,045,232 | 8/1977 | Parkinson | 106/28 |
| 4,055,704 | 10/1977 | Fahimian et al. | 106/27 X |

FOREIGN PATENT DOCUMENTS

| | | | |
|---|---|---|---|
| 445701 | 4/1936 | United Kingdom | 106/28 |

*Primary Examiner*—Bruce H. Hess

[57] ABSTRACT

Pressure-sensitive transfer elements having a polyolefin film foundation carrying a solvent-applied, pressure-transferable complete-release or "correctable" imaging layer comprising a normally-hard resinous binder material, a non-hydroxylated fatty acid oil plasticizer, such as rapeseed oil, which softens or embrittles the resin, a metal salt of a $C_{10}$ to $C_{30}$ fatty acid, such as zinc stearate, which gels the fatty acid oil, and a quantity of coloring matter. The oil plasticizer of the transfer layer is rendered non-migratory and does not penetrate the polyolefin film foundation, even over an extended period of time, and the transfer layer has excellent cohesive properties and excellent frangibility whereby it transfers readily and completely to a copy paper from the film foundation and yet, according to one embodiment, can be removed completely and cleanly from the copy paper by means of conventional lift-off ribbons or tapes.

10 Claims, No Drawings

TRANSFER ELEMENTS AND PROCESS

BACKGROUND OF THE INVENTION

The present invention represents an improvement over known "correctable" ribbons and carbons such as disclosed, for instance, in U.S. Pat. Nos. 3,825,437 and 3,825,470. "Correctable" ribbons were developed in order to facilitate the making of clean corrections by means of a correcting typewriter, whereby an erroneous typed image can be removed cleanly from a copy sheet by overstriking the image with an adhesive ribbon or tape. The "correctable" ribbon composition is formulated so as to be dry, resistant to oil migration into the copy paper onto which it is typed, hard and strongly cohesive, so as to be completely and cleanly removable from the copy paper, and yet brittle so as to have good pressure-transfer properties or frangibility.

In many ways, "correctable" transfer compositions represent a step backward in the art because they must be so dry and brittle that they have poor adhesion for their film foundation and tend to be removable if contacted by the fingers or by the ribbon-transport guides of the typewriter. Also, such compositions must have weak adhesion for the copy paper and frequently the type images are incomplete or have poor edge profile or sharpness.

Conventional correctable ribbons having polyolefin film foundations, such as polyethylene and polypropylene, have been found to be unsatisfactory for the production of correctable transfer elements having good shelf life and capable of producing typed images which are sharp and clear and free of image fill-in. Thus, the more expensive and less deformable polyethylene terephthalate films are being used to avoid these problems.

However, we have found that such problems are not due to the nature of the film foundation but rather are due to the fact that the oily plasticizer migrates from the correctable transfer composition and actually penetrates the polyolefin film foundation to the rear surface thereof, where it is picked up and accumulated on the type faces, such as present on a "golf ball" type element, and most particularly within the enclosed centers of characters such as "o," "p," "e," etc. The accumulated oil attracts dust and paper fibers to the type faces and reduces the ability of such type faces to make uniform, sharp contact with the rear surface of the film, which contact is necessary to the transfer of sharp, clear images free of fill-in.

Mineral oil and fatty acid esters, such as butyl stearate, are used in prior known correctable transfer compositions and function to modify the normally-hard resinous binder material by disrupting its continuity and rendering it brittle so that the resinous coating is frangible and pressure-transferable in image form. However, we have discovered that mineral oils, fatty acid esters and hydroxylated fatty acids, such as ricinoleic acid (castor oil) are penetrants for polyolefin film foundations and prevent the use of such beneficial film foundations as supports for complete release or correctable transfer elements.

BRIEF DESCRIPTION OF THE INVENTION

The present invention involves the discovery that complete release or correctable transfer elements having a polyolefin film foundation and producing sharp, clear correctable images may be produced through the use of solvent-applied resinous imaging layers containing a normally-hard, synthetic resinous binder material, colorant, and a mixture of a non-hydroxylated liquid fatty acid oil which is not a strong penetrant for polyolefin films, such as repeseed oil, together with a metal salt or soap of a $C_{10}$ to $C_{30}$ fatty acid, such as zinc stearate, which functions as a gelling agent or thickening agent to solidify the fatty acid oil within the resin binder and prevents the fatty acid oil from migrating to the surface of the imaging layer or into the copy paper after the composition is transferred thereto in image form. We have found that the polyolefin film foundations, such as polyethylene and polypropylene, are resistant to all saturated and unsaturated fatty acid oils, such as vegetable oils and animal oils, except for hydroxylated fatty acids, such as castor oil, and that such non-hydroxylated fatty acid oils exert the same necessary embrittling effect upon the normally-hard resinous binder material as to the mineral oils and the fatty acid esters, whereby the transfer composition has good frangibility, cohesive strength and greater affinity for the copy paper to which it is transferred than for the polyolefin film foundation. It appears that polyolefin films are not inert with respect to any oils, including the fatty acid oils of the present invention, but that the present oils have sufficiently-low penetrating properties for polyolefin films that such films are resistant to the present oils provided that such oils are rendered non-migratory from the present transfer compositions by being gelled therein by means of the incorporation of a metal salt or soap of a $C_{10}$ to $C_{30}$ fatty acid, such as zinc stearate.

The novel transfer elements of the present invention overcome two separate and distinct problems, each of which is important to the production of correctable ribbons which are capable of producing sharp and clear typed images, free of fill-in, even after prolonged periods of storage, and which are free of oil exudates which can attract dirt to the surface of the imaging layer, can transfer to the ribbon-feeding mechanism of the typewriter and/or can be absorbed by the copy sheet to leave after-traces of the typed images when the typed images are removed from the copy sheet surface during the correction process.

The first problem is overcome by the co-operative effects of the present polyolefin film foundation and the imaging composition present thereon. The polyolefin film foundation, such as polyethylene or polypropylene films having a thickness of less than 1 mil and preferably between about 0.1 and 0.35 mil, has pressure-deforming properties superior to other conventional films and thus conforms most closely to the type face during the typing process to produce typed images having a higher degree of sharpness. The imaging layer is thin and flexible so as not to interfere with the pressure-deformability of the film foundation, the imaging layer having a thickness of from about 0.00005 inch to about 0.0008 inch.

The resistance of the polyolefin film foundation to the imaging layer is due to the exclusion of oily plasticizers for the resinous binder material which are capable of softening and penetrating the polyolefin film foundation, i.e., mineral oils, fatty acid esters and other oleaginous materials which are strong penetrants for polyolefin films, such as castor oil. The preferred plasticizer required to soften and embrittle the normally-hard resinous binder material is rapeseed oil. The plasticizing oil is used in amounts equal to from about 0.5 parts up to about 1.5 parts by weight for each part by weight of the resinous binder material and most preferably in an amount equal to the amount by weight of the resinous binder material. The selection of the particular fatty acid oil or mixture thereof will depend upon the particular resinous binder material used since, obviously, different resins have different plasticizer requirements. However, to the best of our knowledge all animal oils and vegetable oils, other than castor oil, can be used.

The required resistance of the polyolefin film foundation with respect to the imaging composition is also due to the inclusion of a gelling agent for the fatty acid oil comprising a metal salt of a $C_{10}$ to $C_{30}$ fatty acid, commonly referred to as a soap. While such gelling agents have a similar gelling effect upon mineral oils, fatty acid esters and castor oil, such materials, even in the gelled migration-resistant state, are sufficiently strong penetrants for polyolefin films that they cannot be used in imaging compositions present on such films without the deleterious effects discussed hereinbefore.

The preferred soap for use according to the present invention is zinc stearate but other metal salts may also be used, such as the aluminum, calcium, lithium, magnesium, barium and zinc salts of stearic, palmetic, capric, lauric, myristic and similar fatty acids containing from 10 to 30 carbon atoms.

The preferred resinous binder materials are the aliphatic alcohol-soluble polyamide resins commercially-available under the trademark Emerez, most particularly Emerez 1533. However, other normally-hard resins capable of being softened and embrittled by means of vegetable oil plasticizers are also suitable, such as various acrylic resins, vinyl resins, cellulose ester resins, and the like.

The choice of suitable colorant pigments and/or dyestuffs will depend upon the nature of the transfer composition and includes carbon black, magnetic iron oxide, toned pigments, alkali blue, and the like. In the case of correctable imaging compositions, the particular colorant used must be insoluble in the fatty acid oil present in the imaging composition, so as to prevent discoloration of the copy sheet as may occur through absorption if the oil-containing image is present on the copy sheet for a substantial length of time prior to removal during the correction process.

The second distinct problem overcome by the present invention is related to the problem discussed above, namely the staining of the copy sheet in areas from which erroneous images have been lifted and removed. Said problem is substantially reduced by the inclusion of the gelling agent comprising the metal soap of a $C_{10}$ to $C_{30}$ fatty acid, most preferably zinc stearate. The gelling agent is soluble in the particular oil with which it is used and appears to have a beneficial property in addition to its prime function of gelling the fatty acid oil and rendering it nonmigratory. The metal soap also appears to function as an internal and external lubricant for the resinous binder material, improving the release properties of the imaging layer with respect to the polyolefin film foundation while being non-penetrating with respect thereto.

The prime function of the metal soap is to gel the fatty acid oil and render it non-migratory so that it does not exude, sweat or migrate to the surface of the imaging layer to render said surface oily or migrate to the interface of the film and imaging layer to attack and penetrate the film in concentrated form. Since the outer surface of the present imaging layers remains dry, it does not attract dust or paper fibers during use, which materials can cause the transfer of imperfect images. Also, there is no oil and attracted dust or fiber to transfer to and contaminate the ribbon-feeding mechanism of the typewriter during movement of the ribbon.

The amount of metal salt required is fairly small compared to the amount of fatty acid oil present. In general, from about 0.01 to about 0.1 parts by weight of the metal soap is used per part by weight of the oil and most preferably about 0.05 parts by weight of soap per part by weight of oil, i.e., 1 part soap and 20 parts oil. Thus, the metal salt is present in the coating composition in an amount ranging between about 0.005 part and 0.15 part per part by weight of the resinous binder material.

The following example is given as illustrative of the preparation of correctable, complete-release transfer elements according to the present invention and should not be considered limitative with respect thereto:

EXAMPLE

| Ingredients | Parts by Weight | % by Weight Solids |
|---|---|---|
| Polyamide resin (Emerez 1533) | 10.0 | 34.4 |
| Rapeseed oil | 10.0 | 34.4 |
| Zinc stearate | 0.5 | 1.8 |
| Iron oxide | 2.0 | 6.9 |
| Carbon black | 6.5 | 22.5 |
| Naphthalite | 18.0 | 100.00 |
| Heptane | 23.0 | |
| Isopropyl alcohol | 30.0 | |
| | 100.0 | |

The composition is prepared by mixing the oil and zinc stearate with a portion of each of the solvents and heating to form a clear solution, then adding the resin and the remaining isopropyl alcohol to said clear solution until the resin is dissolved. Finally, said solution is added to the pigments and the remaining portion of the other solvents in a ball mill and the mixture is ground to form a uniform coating composition.

The composition is coated directly upon a polypropylene film foundation having a thickness of about 0.33 mil and the solvents are evaporated to form a dry, pressure-transferable imaging layer having a thickness of about five points (0.0005 inch).

After prolonged periods of storage, there is no penetration of the fatty acid oil or any other ingredient of the imaging layer through the polypropylene film and no indication of softening or swelling of the film foundation. Also, the exposed surface of the imaging layer remains dry and free of any oil exudate.

The frangibility of the imaging layer is excellent initially and remains consistent and unchanged even after prolonged periods of storage. Similarly, the removability of typed images is consistently good and free of residual copy sheet-staining whether the transfer element is used immediately or is stored for a prolonged length of time, prior to use.

This consistency over prolonged periods of use is due to the inertness of the imaging layer for the polyolefin film foundation and the non-migratory condition of the gelled fatty acid oil present in the imaging layer.

Variations may be made with respect to present compositions and procedures within the scope of the present claims.

We claim:

1. Pressure-sensitive transfer element of the complete release type comprising a thin flexible polyolefin film foundation having thereon a thin, dry, hard, pressure-transferable imaging layer comprising 1.0 part by weight of a normally-hard synthetic resinous binder material, from about 0.5 part to 1.5 parts by weight of a non-hydroxylated fatty acid oil plasticizer for said binder material which is not a strong penetrant for said polyolefin film, from about 0.005 part to 0.15 part by weight of a metal salt of a $C_{10}$ to $C_{30}$ fatty acid which is a gelling agent for said oil and solidifies said oil plasticizer within said resinous binder material to prevent said oil from migrating therefrom, and an amount of coloring matter.

2. Transfer element according to claim 1 in which said binder material comprises a polyamide resin.

3. Transfer element according to claim 1 in which said fatty acid oil comprises rapeseed oil.

4. Transfer element according to claim 1 in which said metal salt comprises zinc stearate.

5. Transfer element according to claim 1 in which said polyolefin film comprises polypropylene.

6. Process for producing a pressure-sensitive transfer element of the complete release type comprising the steps of:

(a) preparing a coating composition comprising 1.0 part by weight of a normally-hard synthetic resinous binder material, from about 0.5 part to 1.5 parts by weight of a non-hydroxylated fatty acid oil plasticizer for said binder material which is not a strong penetrant for said polyolefin film, from about 0.005 part to 0.15 part by weight of a metal salt of a $C_{10}$ to $C_{30}$ fatty acid as a gelling agent for said oil which solidifies said oil plasticizer within said resinous binder material to prevent said oil from migrating therefrom, a quantity of coloring matter and a volatile coating vehicle comprising a solvent for said binder material;

(b) applying said coating composition as a uniform thin layer to the surface of a thin flexible polyolefin film foundation, and (c) evaporating said volatile coating vehicle to form a uniform thin dry, hard imaging layer which is completely releasable from said film foundation in image form under the effects of imaging pressure.

7. Process according to claim 6 in which said coating composition comprises a major amount by weight of said volatile coating vehicle.

8. Process according to claim 6 in which said coating composition comprises a polyamide resin, rapeseed oil, zinc stearate, coloring matter and an alcohol solvent for said polyamide resin.

9. Process according to claim 6 in which said dry imaging layer has a thickness of between about 0.00005 inch and 0.0008 inch.

10. Process according to claim 6 in which said film foundation has a thickness between about 0.0001 inch and 0.001 inch.

* * * * *